US005501157A

United States Patent [19]

Westerburgen

[11] Patent Number: 5,501,157

[45] Date of Patent: Mar. 26, 1996

[54] FOLDING TABLE

[75] Inventor: Josephus P. M. Westerburgen, Heythuysen, Netherlands

[73] Assignee: Lawn Comfort S.A., Alleur, Belgium

[21] Appl. No.: 299,438

[22] Filed: Sep. 1, 1994

[30] Foreign Application Priority Data

Sep. 2, 1993 [NL] Netherlands ..... 9301519

[51] Int. Cl.[6] ..... A47B 3/00

[52] U.S. Cl. ..... 108/115; 108/169

[58] Field of Search ..... 108/115, 124, 108/128, 123, 132, 166, 167, 169, 170, 171, 173, 174, 175, 176; 248/188.6, 188.7, 188.1

[56] References Cited

U.S. PATENT DOCUMENTS

| | | | |
|---|---|---|---|
| 54,386 | 5/1866 | Mohr | 108/174 |
| 1,242,347 | 10/1917 | Henderson | 108/174 |
| 1,979,843 | 11/1934 | Roos | 108/115 X |
| 3,080,193 | 3/1963 | Nimmo | 108/115 X |
| 3,199,825 | 8/1965 | Bellows . | |
| 3,656,439 | 4/1972 | Domin | 108/115 X |
| 4,643,103 | 2/1987 | Jorgensen | 108/128 X |
| 4,762,321 | 8/1988 | Chang | 108/115 X |
| 5,020,799 | 6/1991 | Chang | 108/115 X |

FOREIGN PATENT DOCUMENTS 3943398 7/1991 Germany .

*Primary Examiner*—Jose V. Chen
*Attorney, Agent, or Firm*—Cushman Darby & Cushman

[57] ABSTRACT

Folding table consisting of a tabletop and a support, which tabletop is composed of two tabletop parts that are connected to one another in such a manner that they can pivot between two extreme positions, the tabletop parts lying in one plane and constituting the tabletop in the first extreme position and the tabletop parts being positioned parallel to one another, their bottom sides facing one another, in the second extreme position, each tabletop part having a rim that is complementary with a rim of the other tabletop part and each tabletop part with the rim part belonging to this complementary rim being connected to a bridge so that it can pivot around an axis parallel to the tabletop, the two axes being parallel to one another, the bottom side of each tabletop part being provided with a toothed wheel segment near the complementary rim, the teeth of which toothed wheel segments are in mesh with one another, and the axis of rotation of each tabletop part coinciding with the axis of the toothed wheel segment.

Each tabletop part is provided with a leg structure that can pivot around an axis that is essentially parallel to the complementary rim of the tabletop part and a bar being provided between the bridge and the leg structure, to which the bar is hinged.

18 Claims, 3 Drawing Sheets

FOLDING TABLE

The invention relates to a folding table consisting of a tabletop and a support, which tabletop is composed of two tabletop parts that are connected to one another in such a manner that they can pivot between two extreme positions, the tabletop parts lying in one plane and constituting the tabletop in the first extreme position and the tabletop parts being positioned parallel to one another, their bottom sides facing one another, in the second extreme position, each tabletop part having a rim that is complementary to a rim of the other tabletop part and each tabletop part with the rim part belonging to this complementary rim being connected to a bridge so that it can pivot around an axis parallel to the tabletop, the two axes being parallel to one another.

Such a table is known from DE-A-3,943,398. In practice it has proved to be rather laborious and difficult for one person to set up such tables. One of the causes of this is that the two tabletop parts can move independently of one another. Furthermore the leg structures have to be moved simultaneously, too. These factors make the whole difficult to use.

The aim of the invention is to provide a table of the type described in the preamble with which the aforementioned drawbacks are avoided.

This aim is achieved according to the invention in that the bottom side of each tabletop part is fitted with a toothed wheel segment near the complementary rim, the teeth of these toothed wheel segments being in mesh with one another and the axis of rotation of each tabletop part coinciding with the axis of the toothed wheel segment.

The coupling of the two tabletop parts by means of a toothed wheel mechanism makes it substantially easier to open out and fold up the table because it suffices to move one tabletop part relative to the leg structure: the kinematic coupling ensures the automatic and correct moving of the other tabletop part.

With a table with which each tabletop part is fitted with a leg structure that can pivot around an axis that is substantially parallel to the complementary rim of the tabletop part a bar is preferably provided between the bridge and the leg structure, to which said bar is hinged.

This ensures that the movement of the leg structure is also kinematically coupled to that of the tabletop parts, which makes the whole even more manageable.

Figure 1:
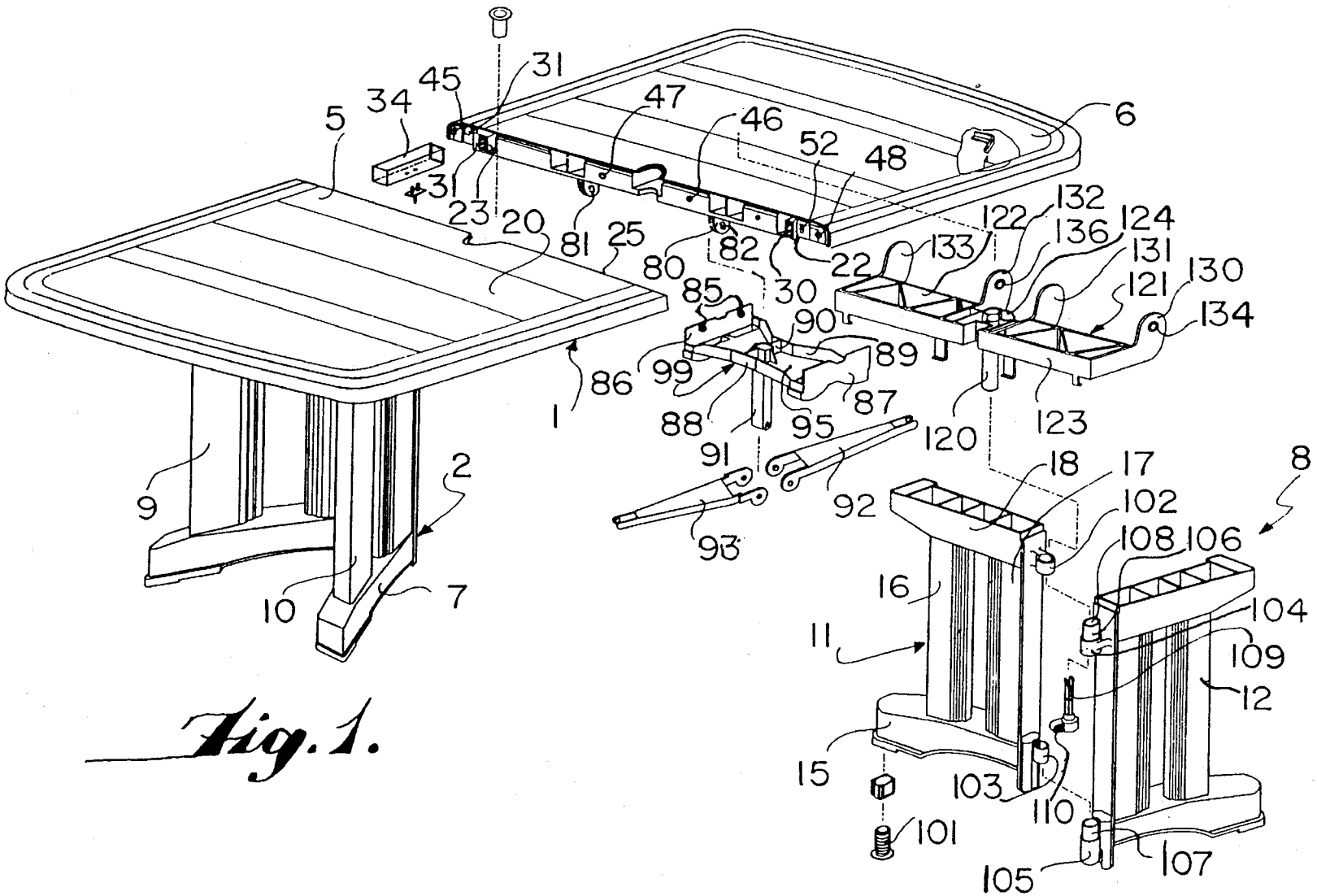
Figure 2:
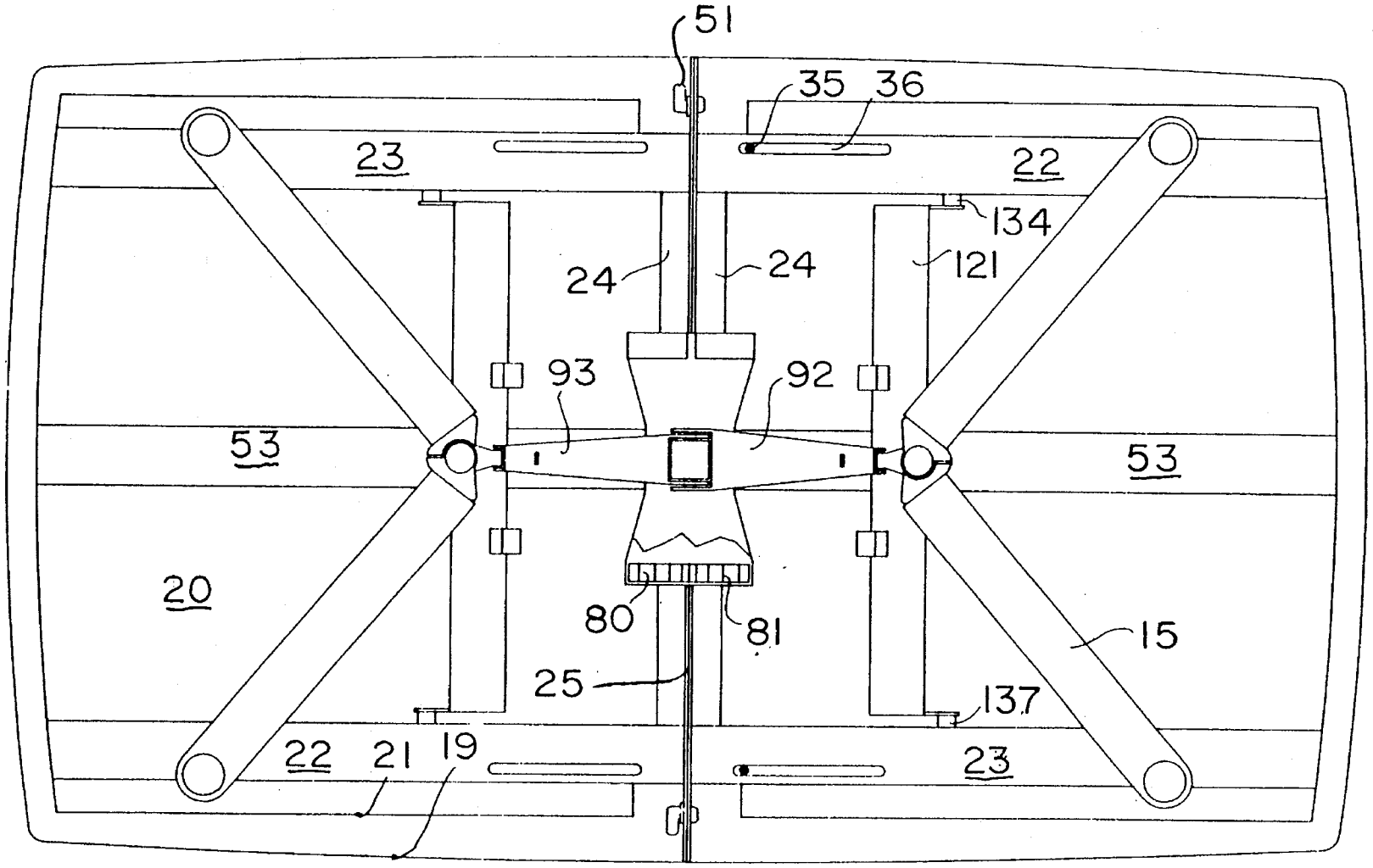
Figure 3:
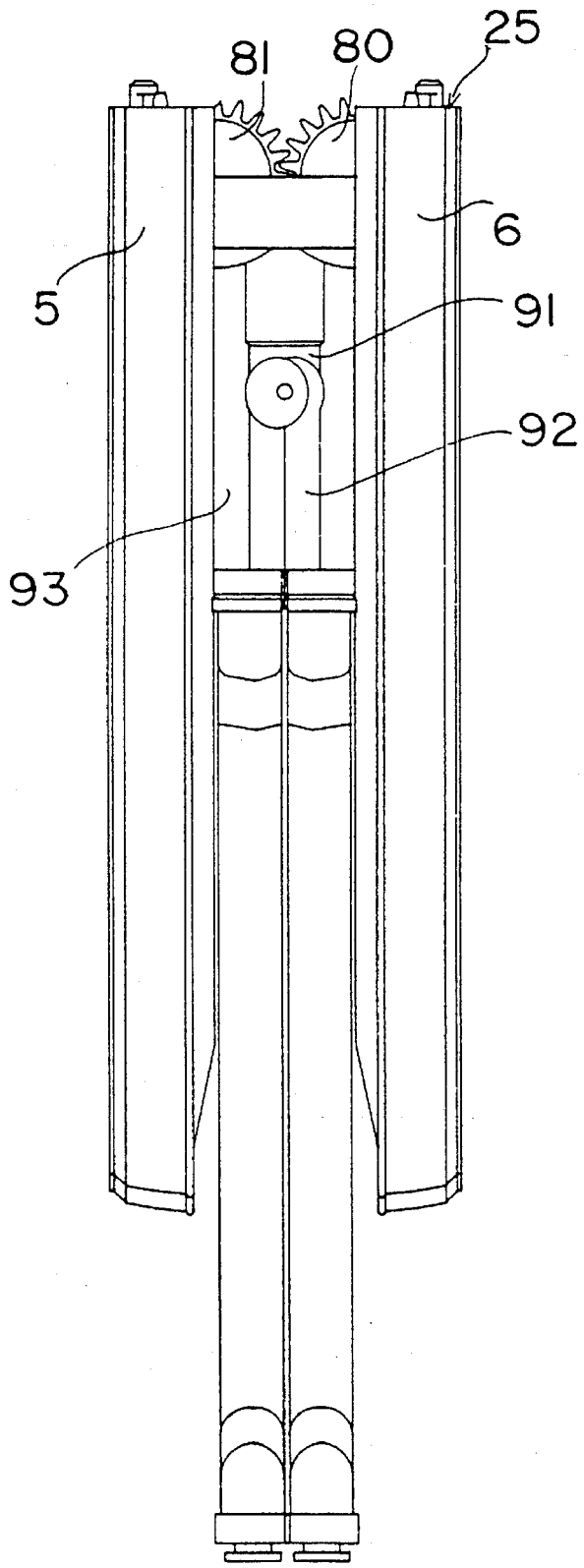

Other characteristics and advantages will become clear from the following description, in which reference is made to the appended drawings, in which:

FIG. 1 is a schematic perspective drawing showing an exploded view of a table according to the invention, FIG. 2 is a partly cross-sectional view of the bottom side of the folding table according to FIG. 1, opened out, and FIG. 3 is a partly cross-sectional side view of the folding table according to FIG. 1, folded up.

As illustrated in FIG. 1, the folding table according to the invention consists of a tabletop (1) and a support (2). The tabletop (1) consists of two tabletop halves (5 and 6) which are in principle identical to one another, as will be described in further detail below. The support (2) consists of two leg structures (7 and 8), each of which leg structures (7 and 8) in turn in principle consists of two leg parts (9 and 10 and 11 and 12, respectively). In principle the leg structures (7 and 8) are the same and the leg parts (9, 10, 11 and 12) are substantially the same. The leg part essentially consists of a first carrier (15) which is connected, by means of two vertical supports (16 and 17), to a second carrier (18) parallel to the first carrier (15), which carrier (18) lies against the bottom side of the tabletop, so that the tabletop rests on the ground via carrier 18, supports 16 and 17 and carrier 15.

Leg parts 9, 10 and 12 are essentially composed in the same manner. The bottom side of carrier 15 may be fitted with an adjusting screw (101), which makes the height of the leg part adjustable.

As shown in FIG. 1, one side of support 17, the side not facing support 16, is fitted with two attached parts (102,103) provided with bores whose axes are vertical to an axis. The corresponding support of leg part 12 belonging to leg part 11 also has two attached parts (104 and 105)

The attached parts 104 and 105 each carry a vertically aimed shaft end, 106 and 107, respectively, which lie in one line. The positions of the attached parts 104 and 105 have been chosen so that when leg parts 11 and 12 are placed next to one another, at the same level, the attached parts 102 and 103, respectively, lie just above the attached parts 104 and 105, respectively. Since the diameter of the bores in the attached parts 102 and 103 is nominally equal to the diameter of the shaft ends (106 and 107), the leg parts can hence be connected to one another so that they can pivot around a vertical axis. Leg parts 9 and 10 are connected to one another so that they can pivot in the same way.

Attached part 104 and the appurtenant shaft end 106 are provided with a vertical bore (108), into which a shaft pin (109) fits. This shaft pin (109) has a length that exceeds that of the bore (108) and after it has been inserted it projects above the shaft end (106).

The part of the shaft pin (109) projecting upwards is accommodated by a bearing bush (120) moulded against the bottom side of a beam (121). The beam (121) consists substantially of two rectangular beam parts (122, 123), which are connected to one another via a link part (124), to which the bearing bush (120) is attached. Further particulars of the leg structure will be described below.

As illustrated, each tabletop part comprises a substantially rectangular, plate-shaped element (20) which constitutes the tabletop proper. Although in the further description reference will be made to a rectangular plate-shaped element, it will be clear that any other shape may be used. In connection with the sturdiness of the plate-shaped element (20), said element has rims (19 and 21) perpendicular to it along three sides, which rims in fact constitute a profile shaped like an inverted U. In addition, two substantially rectangular tubes (22 and 23) are moulded under the plate-shaped element (20), which tubes are integral with the plate-shaped element (20). At the bottom of the fourth side (25) of the plate-shaped element (20) there is also a reinforcing profile (24). This fourth side (25) is the side with which one of the two tabletop parts adjoins the other tabletop part when the table is opened out.

In each of the rectangular tubes (22 and 23) a second tubular part (30 and 31, respectively) has been moulded. When the tabletop parts are positioned with their sides 25 facing one another, the tubular parts (30 and 31, respectively) in one of the two tabletop parts lie in line with the tubular parts (31 and 30, respectively) of the other tabletop part. When a bar (34) is incorporated, in a manner allowing movement, in each of the two pairs of tubular parts lying in line with one another, it can be moved so that it projects partly into both the tubular part (30 or 31) of one of the tabletop parts and into the tubular part (31 or 30, respectively) of the other tabletop part. The bar (34) has a boss (35) which projects through a groove-shaped recess (36) in tube 23, so that the bar (33) can be moved in tubular part 31 via this boss (35). In this way the tabletop can be better supported at the joint between the two tabletop parts when the table is opened out, while the bars (34) can be incorporated in their entirety in tubular parts 30 and 31, respectively, when the table is folded up.

The two tabletop parts are hinged to one another with sides 25 facing one another by means of a structure which will be described in more detail below.

Against the bottom side of the reinforcing profile (24) of tabletop part 6 are two toothed wheel segments which extend over an angle of approximately 90°. The position has been chosen so that the teeth of the toothed wheel segments (80 and 81) project slightly beyond the rim (25) of the appurtenant tabletop part 6. Corresponding toothed wheel segments are moulded on the bottom side of the reinforcing profile (24) of the other tabletop part (5), so that, viewed in the longitudinal direction of the rim (25), the toothed wheel segments lie paired opposite one another and mesh together.

The toothed wheel segments (80 and 81) are connected to the bottom side of the reinforcing profile (24) via an axial plane, while the other axial plane is essentially directed perpendicular to the plane of the tabletop. The sides of the toothed wheel segments (80 and 81) not facing one another on the same tabletop part are each provided with a shaft end, 82 and 83, with a shared axis running parallel to the rim (25). The shaft ends (82 and 83) of two engaged toothed wheel segments are accommodated by bearing openings (85) formed in a bridge (86). The shaft ends of the other pair of engaged toothed wheel segments are also accommodated in bearing openings formed in a bridge (87). Via the bridges (86 and 87) the tabletop parts (5 and 6) are hence hinged together. The bridges (86 and 87) are in turn connected to one another via their ends by link parts (88 and 89). They serve to make the wholemore sturdy and to ensure that the shaft ends (80 and 81) cannot unexpectedly be released from the bearing openings. The two link parts (88 and 89) are connected once more by means of a central support (90) approximately halfway between the bridges (86 and 87). In the illustrated embodiment the link parts (88 and 89) are moreover also connected by means of plate part 95, which ensures even greater stiffness. A rod (91) is attached to this central support (90), which rod projects downwards from the whole constituted by the bridges (86 and 87) and the link parts (88 and 89). The whole constituted by elements 85-95 constitutes bridge part 99.

Near the bottom end of the rod (91) are two bars (92 and 93) that are hinged to said rod. The other ends of the bars (92 and 93) are hinged to the leg structures (8 and 7, respectively).

The hinged connection between bar 92 and leg structure 8 is realised via the shaft pin (109), which is to that end provided with a thickened part (110), in which a bore has been moulded. This ensures that the hinge position is always at the centre of the leg structure.

A number of provisions have been made against and in side 25 of each of the two tabletop parts (5 and 6), which provisions are to ensure that the two tabletop parts adjoin each other well and can also be locked relative to one another. As shown in FIG. 1, two pins (45 and 46) extending in a direction parallel to the tabletop are provided. In addition, two holes (47 and 48) have been made. The design is such that the pins (45 and 46) of one of the two tabletop parts fit into the holes (47 and 48) of another tabletop part when the tabletop parts are positioned so as to adjoin one another. In principle the pins (45 and 46) and the corresponding holes (47 and 48) may have any desired cross section. In addition, a locking device (51) is provided, which can mate with a corresponding opening (52). In the illustrated embodiment the locking device consists of a pin that can rotate in side 25, the end of said pin facing the other tabletop part having a thicker part, so that the pin has an oval cross section at that point and can be accommodated by a corresponding oval opening (51) in one position. The other end of the pin also has a thicker part, which is rather shaped like a handle. When the pin (51) is in the correct position, the two tabletop parts can be positioned against one another, after which, by a twisting of the pin (51) in the opening (52), the two tabletop parts can be locked together. It will however be clear that other locking options are also suitable for fixing the two tabletop parts relative to one another. In this way two tabletop parts can be connected to one another so that they cannot move relative to one another, neither in a direction parallel to the tabletop, nor in a direction perpendicular to the tabletop.

A tube (53) is moulded against the bottom side of each of the tabletop parts (5 and 6) halfway between and parallel to the rectangular tubes (22 and 23). Bearing openings are provided in the sides of the tubes facing one another (22 and 53 and 53 and 23, respectively), which openings lie in line with one another, approximately halfway, viewed in the longitudinal direction of the relevant tabletop part.

As shown in FIG. 1, the short sides of the rectangular beam parts (121 and 122) are each provided with a projecting flange part, 130, 131, 132 and 133, to each of which flange parts (130–133) a pin, 134, 135, 136 and 137, directed away from the appurtenant beam part, is attached. These pins (134–137) fit into the aforementioned bearing openings in the tubes (22, 23 and 53). In this manner beam 121 is connected to the tabletop part so that it can pivot around a horizontal axis, and in this way this leg structure can integrally pivot around a horizontal axis relative to the appurtenant tabletop part.

The operation of the leg structure is essentially identical to the operation described in the Dutch patent application 9201509.

Via the vertical pivot formed by the attached parts (102, 103, 104 and 105) on leg parts 11 and 12, the leg parts can be placed in two positions, a first position in which the legs parts so to speak lie in line with one another, and a second position in which the leg parts are at an angle relative to one another, the vertical parts of leg parts 11 and 12 removed from the vertical pivot substantially projecting in the direction of the corners of the table. In the first position of the leg structure the latter can be pivoted around the horizontal pivot formed by the pins (134–137) and the bores in the tubes (22, 23 and 53) against the bottom side of the tabletop part. This movement is however coupled to the movement of the tabletop parts themselves, namely via the bars (92 and 93), the bridge part (99) and the toothed wheel segments (80 and 81). If the various parts have the right dimensions it is ensured that when one tabletop part is pivoted, the other tabletop part is automatically also pivoted relative to the leg structure. In practice this means that the table can be fairly easily opened out from the position illustrated in FIG. 3 because the leg structures then rest on the floor. When one tabletop part is pivoted, the other tabletop part automatically moves too and when only one of the leg structures is fixed relative to the floor, for example with the aid of the foot, the other leg structure can move more until a position illustrated in FIG. 2 is reached, it being understood that the leg structure is still in the first position.

Then the leg structures can be brought to the second position and the tabletop parts can be fixed together.

It is just as simple to fold up the table because then, too, the movements of the various parts are coupled to one another.

The various parts of the table are preferably made of plastic, which plastic has such an elasticity that self-clamping actions take place.

It will be clear that the invention is not limited to the embodiment described and illustrated above, but that numerous alterations can be made within the framework of the claims.

I claim:

1. A folding table comprising a tabletop and a support, said tabletop having two tabletop parts that are connected to one another in such a manner that enables them to pivotally move between a first position wherein respective top surfaces of the tabletop parts are disposed in a common plane and a second position wherein the tabletop parts are positioned such that respective bottom surfaces of said tabletop parts are disposed parallel to one another and facing one another, each tabletop part having an associated rim that is complementary with a rim of the other tabletop part, each tabletop part and its associated rim being connected to a bridge which enables the tabletop parts to be pivotable about respective axes of rotation which are parallel to one another, each tabletop part being provided with an associated toothed wheel segment at the bottom surface thereof adjacent the rim thereof, said toothed wheel segments of the respective tabletop parts having respective teeth members being in mesh with one another, and wherein the axis of rotation of each tabletop part coincides with the axis of rotation of its associated toothed wheel segment as said tabletop parts pivotally move between said first and second positions with said respective teeth members of said toothed wheels moving in mesh.

2. A folding table according to claim 1, wherein the bottom surface of each tabletop part is provided with additional toothed wheel parts whose axes coincide with the axis of rotation of the associated tabletop part.

3. A folding table according to claim 1, wherein each tabletop part is provided with an associated leg structure that can pivot around an axis that is substantially parallel to the rim of the associated tabletop part, wherein a bar is hingedly connected with the bridge and the associated leg structure.

4. A folding table according to claim 3, wherein each leg structure comprises two leg parts that are connected to one another via a hinge having an axis of rotation perpendicular to the plane of the tabletop when said tabletop parts are in said first position, said leg parts being capable of movement between two extreme positions including a first extreme position in which the leg parts and the associated hinge lie generally in one plane, and a second extreme position in which the leg parts form an angle with respect to one another, the ends of the leg parts furthest from the hinge being disposed further away from the center of the tabletop when the leg parts are in the first position than when the leg parts are in the second position.

5. A folding table according to claim 4, wherein said leg parts can be locked in the second position against relative movement with respect to one another.

6. A folding table according to claim 4, wherein each leg part can be locked in the second position against movement around an axis perpendicular to the plane of the tabletop part.

7. A folding table according to claim 1, wherein the two tabletop parts can be selectively locked relative to one another in either of said first position and said second position.

8. A folding table according to claim 1, wherein the respective rims of the tabletop parts adjoin one another in the first position and are each provided with at least one tubular recess, said recesses being disposed in line with one another when said tabletop parts are in the first position and further comprising a reinforcing bar at least partially disposed in each of said recesses when said tabletop parts are in said first position so as to provide support at a joint between said tabletop parts in said first position.

9. A folding table according to claim 1, wherein the table is substantially made of plastic.

10. A folding table comprising:

a support;

a tabletop mounted on said support, said tabletop having two tabletop parts that are rotatably movable between a first position wherein respective upper surfaces of the tabletop parts are in one plane and a second position wherein respective bottom surfaces of the tabletop parts are disposed in parallel facing relation with respect to one another;

a pair of reinforcing rims, each associated with a respective one of said tabletop parts;

a bridge constructed and arranged to interconnect one of said tabletop parts and its associated reinforcing rim with the other of said tabletop parts and its associated reinforcing rim; and at least one toothed wheel segment connected with each tabletop part, each said toothed wheel segment having a plurality of teeth, and each toothed wheel segment of said one tabletop part being cooperable with a related toothed wheel segment of said other tabletop part such that the teeth of said related toothed wheel segments are in mesh with one another, said related toothed wheel segments defining respective axes of rotation about which the associated tabletop part pivots during rotational movement of said tabletop parts between said first and second positions, said axes being disposed in spaced parallel relation with respect to one another.

11. A folding table according to claim 10, wherein each tabletop part is provided with a plurality of toothed wheel parts each sharing a common axis which is coincident with the axis of rotation of the associated tabletop part.

12. A folding table according to claim 10, wherein each tabletop part is provided with an associated leg structure that can pivot around an axis that is substantially parallel to the rim of the associated tabletop part, wherein a bar is hingedly connected with the bridge and the associated leg structure.

13. A folding table according to claim 12, wherein each leg structure comprises two leg parts that are connected to one another via a hinge having an axis of rotation perpendicular to the plane of the tabletop when said tabletop parts are in said first position, said leg parts being capable of movement between two extreme positions including a first extreme position in which the leg parts and the associated hinge lie generally in one plane, and a second extreme position in which the leg parts form an angle with respect to one another, the ends of the leg parts furthest from the hinge being disposed further away from the center of the tabletop when the leg parts are in the first position than when the leg parts are in the second position.

14. A folding table according to claim 13, wherein said leg parts can be locked in the second position against relative movement with respect to one another.

15. A folding table according to claim 13, wherein each leg part can be locked in the second position against movement around an axis perpendicular to the plane of the tabletop part.

16. A folding table according to claim 10, wherein the two tabletop parts can be selectively locked relative to one another in either of said first position and said second position.

17. A folding table according to claim 10, wherein the respective rims of the tabletop parts adjoin one another in the first position and are each provided with at least one tubular recess, said recesses being when said tabletop parts are in the first position and further comprising a reinforcing bar at least partially disposed in each of said recesses disposed in line with one another when said tabletop parts are in said first position so as to provide support at a joint between said tabletop parts in said first position.

18. A folding table according to claim 10, wherein the table is substantially made of plastic.

* * * * *